United States Patent [19]

Triplett

[11] Patent Number: 4,686,808

[45] Date of Patent: Aug. 18, 1987

[54] ROOFING SYSTEM, METHOD AND HOLDDOWN APPARATUS

[75] Inventor: Carol J. Triplett, Huntertown, Ind.

[73] Assignees: John D. Gray, Avilla; Charles S. Triplett, Ft. Wayne, both of Ind.

[21] Appl. No.: 475,159

[22] Filed: Mar. 14, 1983

[51] Int. Cl.[4] ..... E04B 5/00

[52] U.S. Cl. ..... 52/410; 52/411; 52/512; 52/747; 411/369; 411/373; 411/542; 411/544; 411/903

[58] Field of Search ..... 52/410, 411, 412, 408, 52/409, 506, 512, 741, 747, 641, 643, 647; 411/368, 369, 371, 373, 531, 542, 544, 900, 901, 902, 903

[56] References Cited

U.S. PATENT DOCUMENTS

| | | | |
|---|---|---|---|
| 1,111,034 | 9/1914 | Robertson | 411/531 |
| 2,417,262 | 3/1947 | Morehouse | 411/542 |
| 2,927,495 | 3/1960 | Barwood | 411/371 |
| 3,191,730 | 6/1965 | Fischer | 52/403 |
| 3,398,496 | 8/1968 | Mischke | 52/467 |
| 3,566,738 | 3/1971 | Cupid | 411/369 |
| 4,059,933 | 11/1977 | Funk et al. | 52/467 |
| 4,074,501 | 2/1978 | Sandquist | 52/410 |
| 4,280,390 | 7/1981 | Murrdy | 411/542 |
| 4,389,826 | 6/1983 | Kelly | 52/410 |
| 4,439,968 | 4/1984 | Dunn | 52/506 |
| 4,467,581 | 8/1984 | Francovitch | 52/512 |
| 4,476,660 | 10/1984 | Francovitch | 52/512 |

FOREIGN PATENT DOCUMENTS

| | | | |
|---|---|---|---|
| 1115999 | 1/1982 | Canada | 411/369 |
| 1050037 | 2/1959 | Fed. Rep. of Germany | 411/373 |
| 1206138 | 12/1965 | Fed. Rep. of Germany | 52/467 |

*Primary Examiner*—John E. Murtagh
*Assistant Examiner*—Andrew Joseph Rudy
*Attorney, Agent, or Firm*—Lundy and Walker

[57] ABSTRACT

A holddown to be used in conjunction with a headed fastener, a roofing system and a method utilizing the same. The holddown comprises a disc-shaped spring and a body encasing the spring. The fastener is interpositionable within a hole in the body of the holddown and displacement of the fastener applies a compressive force to the holddown. The spring is deformable from an unbiased position to a biased postion by the compressive force. The body is deformable from an unconstrained shape to a constrained shape by the deformation of the spring. The holddown is usable in conjunction with both the fastener and pliant filler to affix roofing material in a watertight relationship to a roof structure and to maintain the same in position against the forces applied by the wind.

17 Claims, 6 Drawing Figures

ROOFING SYSTEM, METHOD AND HOLDDOWN APPARATUS

BACKGROUND OF THE INVENTION

The invention pertains to a roofing system in which the roof is overlayed with sheet rubber and secured in place by a plurality of spaced apart holddowns and more particularly to improvements in the system, the method of securing the sheet rubber in place and the holddown.

For some years, it has been common practice to cover roofs that extend horizontally or at comparitively small angles of inclination with sheets of rubber. Such a roof is good protection against the penetration of water to the framework of the roof and is more durable than conventional BUR roofing of tar and tar paper. The term "rubber" in this application is used to encompass polyvinyl chloride sheets, EPDM sheets, and other natural or synthetic resinous materials having the physical and chemical properties of a "rubber". These rubber sheets are usually laid on top of a neat insulating under layer and naturally must be anchored so as not to be blown off or slide away from the roof. For this purpose, in the past, the rubber sheets are, for the most part, adhesively secured to the under layer or overlaid with gravel. In one type of installation the sheets are secured by means of spaced apart holddowns in the form of plates or moldings of sheet metal or plastic through which are passed fasteners, such as screws or nails, which are in turn screwed or nailed into the roof support. Such a prior art roofing system is disclosed in U.S. Pat. No. 4,074,501 issued to Sandqvist on Feb. 21, 1978.

Holddowns, washers or other devices used in conjunction with a fastener are very old. They act by spreading the force applied by the fastener over a larger area than that of the head of the fastener. This reduces stress at any one point and helps secure the fastened item. The shortcoming of these holddowns is that their useful size is limited since they do not apply force well over an area much in excess of the size of the head of the fastener. This limits their usefulness in situations where large stresses are applied to a relatively fragile material such as in securing roof system membranes. Additionally, these holddowns may damage the rubber sheets upon installation and because of such damage or other reasons do not provide a good watertight seal even when used in conjunction with caulking or rubber members in applications where stresses are large such as in roof system membranes.

It is therefore highly desirable to provide an improved holddown and roofing system and method. The holddown comprises a body encasing a deformable spring. The body being deformable from an unconstrained shape to a constrained shape by application of a compressive force by displacement of a fastener interpositioned within a hole in the body of the holddown.

It is also highly desirable to provide an improved holddown that applies a force over a large area.

It is further highly desirable to provide an improved holddown and roofing system and method that can be used with a fastener and pliant filler to affix material in watertight relationship to a structure.

It is likewise highly desirable to provide an mproved holddown that provides a tight seal when it is attached.

It is yet also highly desirable to provide an improved holddown and roofing system and method that is easy and economical to use.

It is still further highly desirable to provide an improved holddown that when used on top of a membrane in a roof system can withstand wind uplift.

It is yet further highly desirable to provide an improved holddown that has a smoothly tapered upper surface that will not trip persons walking over it.

It would finally be highly desirable to provide an improved holddown which meets all the above desired features.

SUMMARY OF THE INVENTION

It is an object of the invention to provide an improved holddown and roofing system and method.

Another object of the invention is to provide an improved holddown that applies a force over a large area.

Yet another object of the invention is to provide an improved holddown and roofing system and method that can be used with a fastener and pliant filler to affix material in watertight relationship to a roof structure.

Still another object of the invention is to provide an improved holddown that provides a tight seal when it is attached.

Yet still a further object of the invention is to provide an improved holddown and roofing system and method that is easy and economical to use.

It is yet also another object of the invention to provide an improved holddown that when used on top of a membrane in a roof system can withstand wind uplift.

It is still also another object of the invention to provide an improved holddown that has a smoothly tapered upper surface that will not trip persons walking over it.

In the broader aspects of the invention there is provided a holddown to be used in conjunction with a headed fastener, a roofing system and a method utilizing the same. The holddown comprises a disc-shaped spring and a body encasing the spring. The fastener is positioned within a hole in the body of the holddown and displacement of the fastener applies a compressive force to the holddown. The spring is deformable from an unbiased position to a biased position by the compressive force. The body is deformable from an unconstrained shape to a constrained shape with the deformation of the spring. The holddown is usable in conjunction with the fastener and a pliant filler to affix roofing material in a watertight relationship to a roof structure and to maintain the same in position against the forces applied by the wind.

BRIEF DESCRIPTION OF THE DRAWINGS

The above mentioned and other features and objects of this invention and the manner of obtaining them will become more apparent and the invention itself will be better understood by reference to the following description of an embodiment of the invention taken in conjunction with the accompanying drawings wherein.

DESCRIPTION OF A PREFERRED EMBODIMENT

Figure 1:
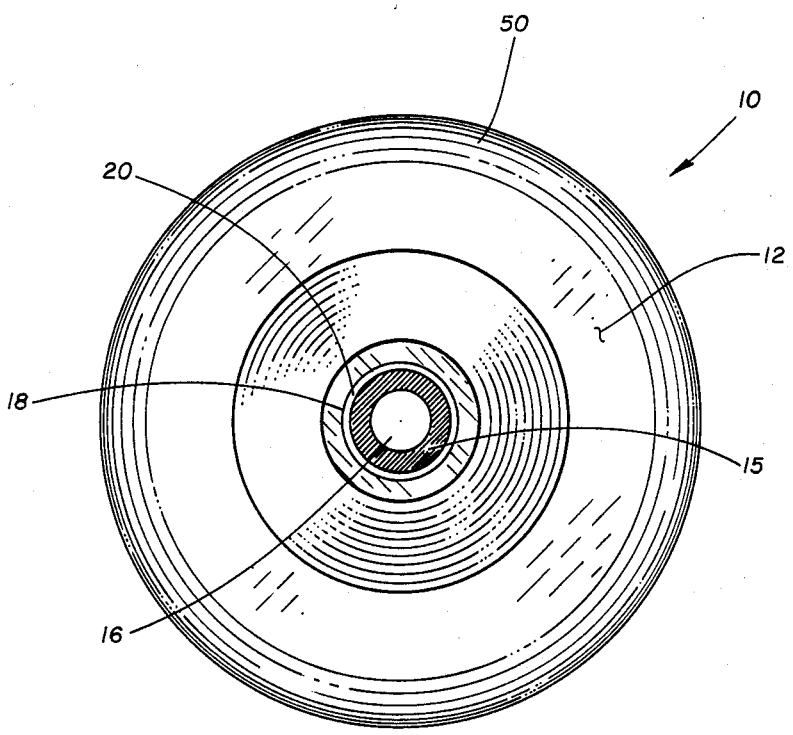
FIG. 1 is a top plan view of the holddown of the invention.
Figure 2:
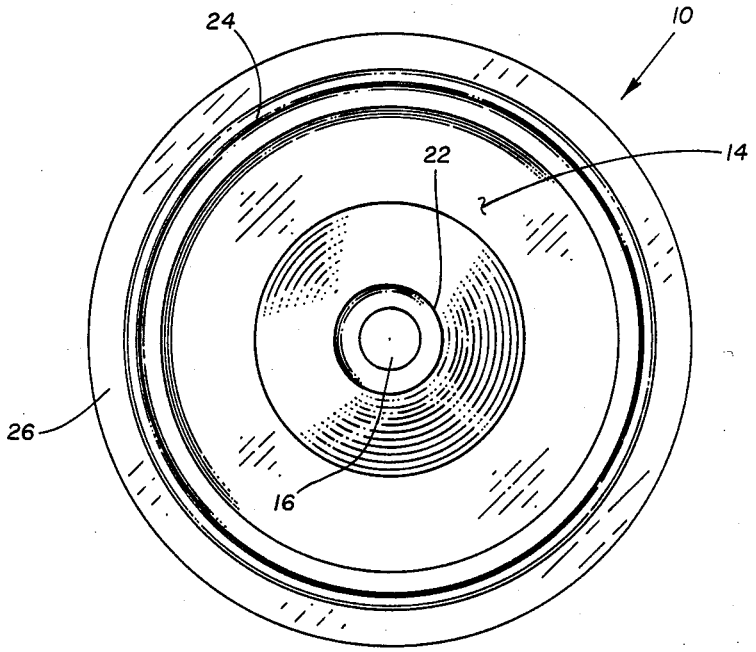
FIG. 2 is a bottom plan view of the holddown of the invention.

Referring to FIGS. 1 through 4, the holddown 10 of the invention is shown to have a body 50 with a upper surface 12 and a lower surface 14. Upper surface 12 is generally concave and has a tapered perimeter to allow foot traffic without persons tripping on them. Lower surface 14 is generally planar. The body 50 has a hole 16 in the center thereof, is generally disc-shaped and is made of a compressable and resilient material.

Body 50 has an upper surface cavity 18 is disposed in the upper surface 12. The upper surface cavity 18 has a cylindrical wall which is concentric with the hole 16 and extends between bottom 15 and upper surface 12. Wall 17 has ridge 20 protruding from wall 17 and encircling hole 16. Ridge 20 is spaced from upper surface cavity bottom a sufficient distance to allow the fastener to be mentioned hereinafter to be positioned between bottom 15 and ridge 20 when the holddown 10 is properly installed.

Lower surface 14 is encircled by an annular peripheral ridge 26 which extends outwardly from the lower surface 14 and defines a bottom cavity 13. Outer ring 24 extends outward from the peripheral ridge 26. An inner ring 22 encircles the hole 16 and both extends outward from the lower surface 14 and tapers outwardly of hole 16 toward lower surface 14. Ridge 26 and rings 22, 24 are each compressible and concentric with hole 16.

A spring 28 is encased by the body 50 and integral within the body 50. Spring 28 has an aperture 54 in the center thereof and an upper and lower edges 38, 40 surrounding aperture 54. Upper edge 38 defines aperture 54. Lower edge 40 defines the outer periphery of spring 28. Aperture 54 and hole 16 are concentric. In a specific embodiment, the hole 16 and the aperture 54 are coextensive.

Spring 28 has a plurality of annularly shaped portions 42, 44, 46, 48, 50 and 52 between the upper edge 38 and the lower edge 40. Spring 28 has a central portion 42 adjoining the upper edge 38. The central portion 42 is roughly coplanar witn the upper edge 38. The central portion 42 has an annular shape and is concentric with the aperture 54.

Spring 28 has an outer portion 52 between the central portion 42 and the lower edge 40. The outer portion 52 also has an annular shape and is concentric with the aperture 54. In a specific embodiment, the lower edge 40 of the spring 28 is recurvate. The outer portion 52 of spring 28 is divided into a first sloped portion 44, an intermediate portion 46 and a second sloped portion 48. The first sloped portion 44, the intermediate portion 46 and the second sloped portion 48 each have an annular shape and are concentric with the aperture 54. The first sloped portion 44 adjoins the central portion 42 and is sloped from the central portion toward the lower surface 14 when the spring 28 is in its unbiased position. The intermediate portion 46 adjoins the first sloped portion 44. The second sloped portion 48 adjoins the intermediate portion 46 and the lower edge 40. The second sloped portion is sloped from the intermediate portion 46 toward the lower edge 40 when the spring 28 is in its unbiased position. Lower edge 40 is spaced from the periphery of body 50 and over perepheral edge 26. In a specific embodiment, lower edge 40 is positioned over ring 24. In all embodiments, body 50 extends diametrically beyond lower edge 40.

A fastener 30 having a shaft 58 and having a head 60 at one end of the shaft 58 is interpositionable in hole 16 of the invention 10 and aperture 54 of spring 28. The hole 16 and aperture 54 have diameters greater than the diameter of the shaft 58. The hole 16 and aperture 54 have diameters less than the width of the head 60 of the fastener 30. Similarly, the upper surface cavity 18 is of a size sufficient to permit interpositioning of the head 60 of the fastener 30 within cavity 18 adjacent bottom 15.

Figure 4:
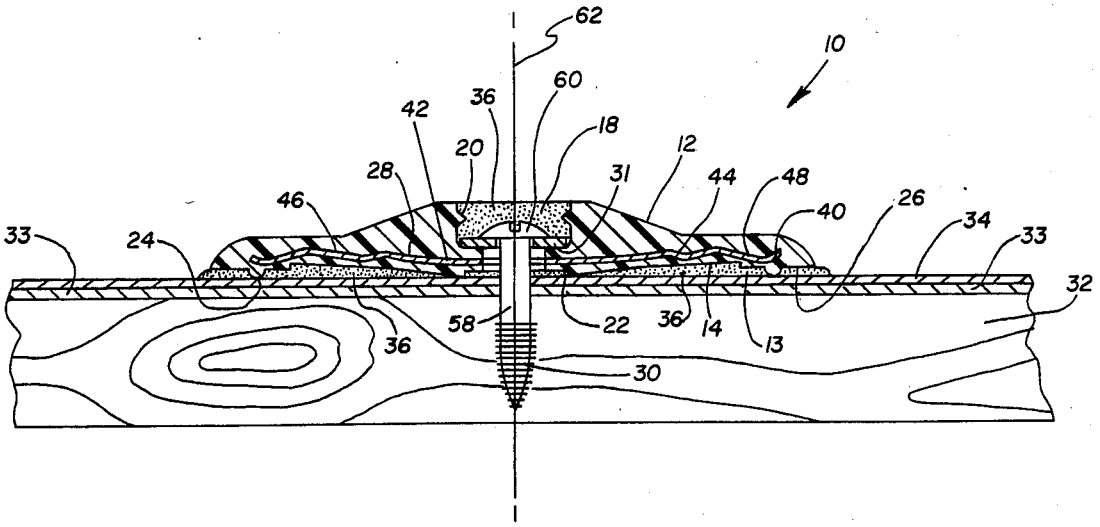
FIG. 4 is a fragmentary view showing the holddown similar to FIG. 3 and pliant filler as used to apply roofing material to a roof structure in a watertight relationship. The spring is in its biased position and the body is in its constrained position.

The fastener 30 in FIG. 4 is a screw, however, the invention 10 is not limited to that specific type of fastener 30. Whatever type of fastener 30 is desirable for a particular application is usable with the invention 10, subject only to the limitation that the fastener 30 has a shaft 58 with a head 60 at one end.

Figure 3:
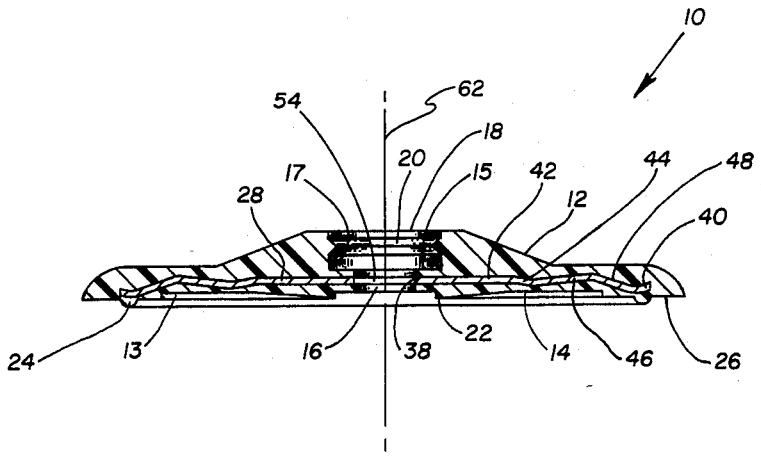
FIG. 3 is a cross section of the holddown shown in FIGS. 1 and 2 with the spring in its unbiased position and the body in its unconstrained position.

Spring 28 is deformable from an unbiased position to a biased position by a compressive force applied at the upper edge 38 in a direction from the upper edge 38 toward the lower edge 40. The body 50 is deformable or distortable from an unconstrained shape to a constrained shape by the deformation of the spring 28. In FIG. 3 the spring 28 is in its unbiased position and the body 50 is in its unconstrained shape. In FIG. 4, spring 28 is in its biased position and body 50 is in its constrained shape.

When the shaft 58 of the fastener 30 is interpositioned within hole 16, head 60 of the fastener 30 bears upon the upper surface 12 adjacent the upper edge 38 of the spring 28. When the fastener 30 is displaced in a direction from the upper edge 38 toward the lower edge 40 the compressive force is applied to the body 50 by the head 60 of the fastener 30 and through the body 50 to the spring 28 resulting in the deformation of the spring 28 and the body 50. In this manner, head 60 applies a compressive force directly to ring 22 of body 50 and applies indirectly a compressive force to ring 24. In a specific embodiment, a washer 31 is positioned in cavity 18 between head 60 and oottom 15 to further assure that a compressive force is applied directly to ring 22 by head 60. Washer 31 also protects body 50 from damage by fastener 30.

Figure 5:
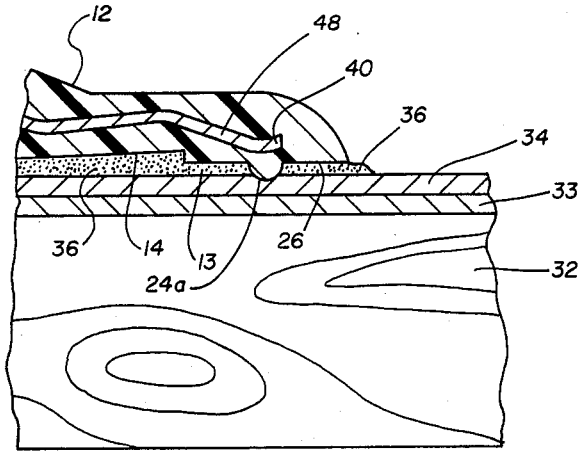
FIG. 5 is a fragmentary and enlarged view of the structure shown in FIG. 4, illustrating the cooperation between the holddown, pliant roofing material, filler, and roof structure to result in a watertight seal.
Figure 6:
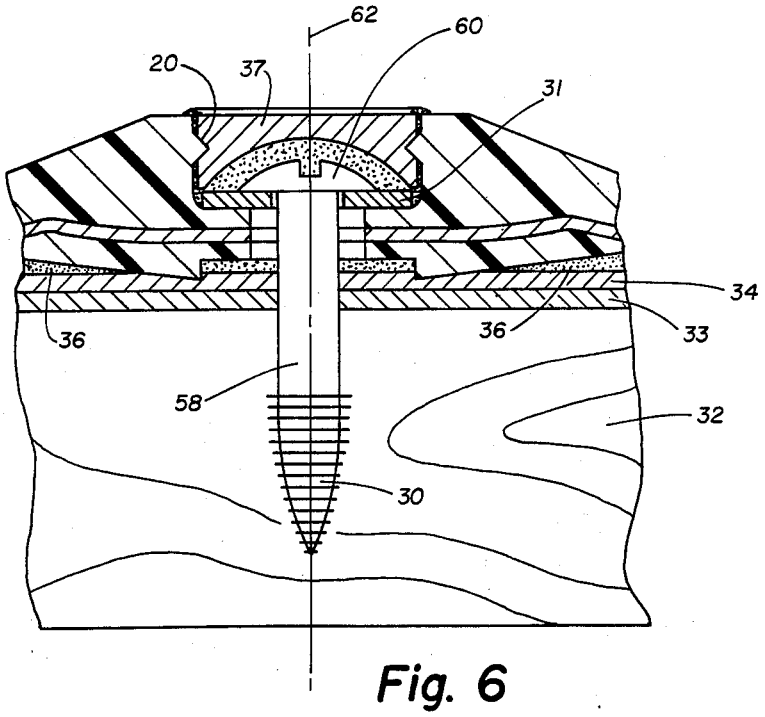
FIG. 6 is a fragmentary view similar to FIG. 4 showing an alternate method of sealing the upper surface cavity of the holddown of the invention.

In a specific application, the invention 10 may be used in conjunction with fastener 30 and pliant filler 36 to affix material 34, in watertight relationship to a structure 32 as in a roof structure. In FIGS. 4, 5 and 6 the holddown 10 is shown so applied.

Material 34 is illustrated in FIGS. 4, 5 and 6 as being thin in relation to the structure 32. It is highly desirable to use the holddown 10 where the material 34 is thin such as in applying roof system membranes since the holddown 10 reduces stresses on the material 34 and provides a secure attacnment of the material 34 to structure 32. However, the holddown 10 is not limited to such and the holddown 10 may be used irrespective of relative and absolute thicknesses of material 34 and structure 32. The appropriate fastener 30 to be used with the invention 10 may vary with the individual application.

In FIG. 4, fastener 30 is shown as having been connected through material 34 and through an under layer 33 to the structure 32. In a specific embodiment, under layer 33 may or may not be used. In a roof structure an under layer is usually used to provide a smooth clean surface for material 34. Under layer 33 can be fibre board, gypsum board, sheet rock or insulation board. Fastener 30 deforms the spring 28 from an unbiased position to a biased position and deforms body 50 from an unconstrained shape to a constrained shape. Lower surface 14 is generally planar wnen the body is in its unconstrained shape as illustrated in FIG. 3 and generally convex when the body is in its constrained shape as illustrated in FIG. 4. The deformation of the lower surface 14 from the generally planar shape to the generally convex shape, places the lower surface 14, material 34 and the structure 32 or the under layer 33, or the case may be, into a watertight relationship. Rings 22, 24 and material 34 are compressed between spring 28 and structure 32 or under layer 33.

A pliant filler 36 is shown positioned in cavity 13. When fastener 30 deforms spring 28 and body 50, pliant filler 36 is squeezed between body 50 and material 34 overlaying structure 32 complete filling cavity 13 within rings 22, 24 and oozing filler 36 outwardly past ring 24 and peripheral ridge 26. Examples of pliant filler 36 are rubber or caulk but the invention is not limited to these and other pliant fillers are appropriate.

With the head 60 of fastener 30 bearing upon bottom 15 within the upper surface cavity 18, the upper surface cavity 18 is also sealable by pliant filler 36 (FIG. 4) or by pliant filler 36 and plug 37 (FIG. 6) thereby maintaining the fastener 30 and body 50 in a watertight relationship. Ridge 20 within the upper surface cavity 18 maintains pliant filler 36 or plug 37 and pliant filler 36 within the upper surface cavity 18 and retains the watertight relationship under conditions where the holddown 10 is under mechanical stress.

Peripheral ridge 26 extending outwardly from the lower surface 14, contacts the material 34 when the body 50 is in its constrained shape retains the pliant filler 36 between the lower surface 14 and the material 34, and retains the material 34 in place against the structure 32 in the manner of a suction cup.

Outer seal ring 24 and inner seal ring 22 also extend outward from the peripheral rim 26 and the lower surface 14, respectively. Outer seal ring 24 and inner seal ring 22 are compressible and mechanically seal the holddown 10 and the material 34 to retain the watertight relationship between the holddown 10, the material 34 and the structure 32.

In many applications, the structure 32 or the under layer 33, as the case may be, permanently conforms to the shape of the lower surface 14 (see FIG. 5 at 24*a*), and thereby, in time, allows fastener 30 to loosen and the water-tight relation between holddown 10 and structure 32 or under layer 33 to leak. By the structure of spring 28, continuous force is applied to the structure 32 or under layer 33 and fastener 30 such that fastener 30 remains tight and the water-tight relation between holddown 10 and structure 32 or under layer 33 is maintained. This is accomplished by washer 31 being adjacent and overlaying inner seal 22 and lower edge 40 of the spring 28 being adjacent and overlaying outer seal 24. By this structure and the afore-described structure of holddown 10, the force applied by the fastener is efficiently used to compress outer seal 24 and inner seal 22 and maintain the holddown 10 and spring 28 in its constrained and biased positions, respectively. In a specific embodiment in which holddown 10 measures about 4 inches in diameter, lower edge 40 is about 0.040 inches lower than the upper edge 22. This ensures sufficient transfer of the compressive force through the spring 28 and the body 50 to the outer seal 24 to maintain the desired seal.

The sheet materials used in roofing applications are also subject to damage during both installation and use from the device used to install the same. For this additional reason, body 50 of holddown 10 of the invention is made of flexible and resilient material. No portion of fastner 30 or spring 28 comes in contact with material 34 when installed as shown in FIG. 4. Further, body 50 is provided with a blunt and smooth peripheral edge and diametrically extends beyond spring 28 such that body 50 may flex upwardly if necessary and will not cause damage to material 34 during normal use.

While there has been described above the principles of the invention in connection with a specific holddown device, it is to be clearly understood that this description is made only by way of example and not as a limitation to the scope of the invention.

What is claimed is:

1. A holddown to be used in conjunction with a headed fastener, said holddown comprising a circular spring having an aperture and upper and lower edges, said upper edge surrounding said aperture, a circular body encasing said spring, said body having an upper surface and a lower surface, said body having a hole concentric with said aperture, said hole and aperture being of a size sufficient to permit the interpositioning of the shaft of a headed fastener therein with said head bearing upon said upppr surface adjacent to said upper edge of said spring, said spring being deformable from an unbiased position to a biased position by a compressive force applied at said upper edge in a direction from said upper edge toward said lower edge by said fastenr said body being deformable from an unconstrained shape to a constrained shape with said deformation of said unbiased position to said biased position, said spring having central and outer portions, said central portion adjoining said upper edge, said central portion having an annular shape concentric with said aperture, said spring outer portion being between said central portion and said lower edge, said outer portion also having an annular shape concentric with said aperture, said central portion being above said outer portion when said spring is in said unbiased position.

2. The holddown of claim 1 wherein spring is integral within said body.

3. The holddown of claim 1 wherein said outer portion of said spring has a first sloped portion adjoining said central portion, said first sloped portion having an annular shape concentric with said aperture, said first sloped portion being sloped from said central portion toward said lower surface when said spring is in said unbiased position, said outer portion of said spring having an intermediate portion adjoining said first sloped portion, said intermediate portion having an annular shaped concentric with said aperture, said intermediate portion being roughly coplanar with said central portion when said spring is in said unbiased position, said outer portion of said spring having a second sloped portion adjoining said intermediate portion and said lower edge, said second sloped portion having an annular shaped concentric with said aperture, said second sloped portion being sloped from said intermediate portion to said lower edge when said spring is in said unbiased position.

4. The holddown of claim 3 wherein said lower edge is recurvate.

5. The holddown of claim 1 wherein said body extends beyond said spring diametrically of said aperture, said body being beyond said spring being flexible independently of said spring.

6. the holddown of claim 1 wherein said body has a peripheral edge, said peripheral edge being blunt and smoothly shaped.

7. A holddown for use with a headed fastener and a pliant filler to affix sheet material to a structure, in watertight relationship, said holddown comprising a circular spring having a lower edge and an upper edge, said spring having an aperture therein surrounded by said upper edge, said spring being deformable from an unbiased position to a biased position by a compressive force applied at said upper edge in a direction from said upper edge toward said lower edge, said spring having a central portion adjoining said upper edge, said central portion having an annular shape concentric with said aperture and being roughly coplanar with said upper edge, said spring having a first sloped portion adjoining said central portion, said first slope portion having an annular shape concentric with said aperture and being sloped from said central portion towards said lower edge when said spring is in said unbiased position, said spring having an intermediate portion, said intermediate portion having an annular shape concentric with said aperture, said spring having a second sloped portion between said intermediate portion and said lower edge, said second sloped portion having an annular shape concentric with said aperture , said second sloped portion being sloped from said intermediate portion to said lower edge when said spring is in said unbiased position, a circular body encasing said spring, said body being deformable from an unconstrained shape to a constrained shape by said deformation of said spring from said unbiased position to said biased position, said body having a hole concentric with said aperture, said hole and aperture being of a size sufficient to permit the interpositioning of the shaft of a headed fastener therein, said body having an upper surface, said upper surface having an upper surface cavity concentric with said hole, said upper surface cavity being of a size sufficient to permit interpositioning of the head of said fastener therein, said upper cavity adapted to accomodate pliant filler thereby to maintain said hole and said upper surface in a watertight relationship, said body having a lower surface, said lower surface being generally planar when said body is said unconstrained position and being generally convex wnen said body is in said constrained position, said body having a peripheral ridge extending outward from said lower surface, said peripheral ridge adapted to hold pliant filler between said holddown and sheet material overlaying a supporting structure when said fastener is interpositioned in said body and connected through said material to said structure and deforming said body to said constrained shape said lower surface being deformed from said generally planar shape to said generally convex shape, said pliant filler being between said lower surface and said material in a generally continuous layer, whereby said lower surface, said hole, said material, and said structure is maintained in a watertight relationship.

8. The holddown of claim 7 further comprising an outer ring extending outward from said peripheral ridge, said outer ring being compressible, and an inner ring extending outward from said lower surface, said inner ring surrounding said hole, said inner ring being compressible.

9. The holddown of claim 7 further comprising a ridge on said body projecting into said upper cavity to hinder removal of said pliant filler from said upper cavity.

10. The holddown of claim 8 wherein said lower edge of said spring is adjacent to said outer ring.

11. The holdown of claim 7 wherein the thickness of said body adjacent to said central portion of said spring in a direction parallel to the axis of said hole is greater than the thickness of said body adjacent said intermediate portion of said spring, said upper surface being smoothly contoured.

12. A holddown for use with a headed fastener, said holddown comprising a circular spring having a recurvate lower edge and an upper edge, said spring having an aperture surrounded by said upper edge, said spring having a plurality of annularly shaped portions between said upper edge and said lower edge, said annularly shaped portions being concentric with said aperture, a body surrounding said, said circular spring and spring having roughly a disc shape, said body a hold concentric with said spring, said body having a hole concentric with said aperture, said hole and aperture having a diameter greater than the diameter of the shaft of a headed fastener but less than the diameter of the head of said fastener, said spring being resiliently deformable from an unbiased position to a biased position by a compressive force applied at said upper edge in a direction from said upper edge toward said lower edge, said body being resilient and distortable from an unconstrained shape to a constrained shape by said deformation of said spring from said unbiased position to said biased position, whereby the displacement of said fastener within said hole in a direction from said upper edge of said spring toward said lower edge of said spring causes said head to apply said compressive force to said body adjacent said upper edge of said spring.

13. A method comprising the steps of overlaying a roof structure with a water proof sheet material, placing a holddown on said sheet material, said holddown comprising a circular spring having an aperture and upper and lower edges, said upper edge surrounding said aperture, a circular body encasing said spring, said body having an upper surface and a lower surface, said body having a hole concentric with said aperture, positioning the shaft of a headed fastener in said aperture with the head thereof bearing upon said upper surface adjacent to said upper edge of said spring, said spring being deformable from an unbiased position to a biased position by a compressive force applied at said upper edge in a direction from said upper edge toward said lower edge by said fastener, said body being deformable from an unconstrained shape to a constrained shape with said deformation of said spring from said unbiased position to said biased position, positioning pliant filler between said holddown and said sheet, applying said compressive force to said body and spring, and securing said fastener shaft to said roof structure so as to hold said spring in its biased position, said spring having central and outer portions, said central portion adjoining said upper edge, said central portion having an annular shape concentric with said aperture, said spring outer portion being between said central portion and said lower edge, said outer portion also having an annular shaped concentric with said aperture, said central portion being above said outer portion when said spring is in said unbiased position.

14. A roof system comprising a roof support, a sheet of waterproof material, and a holddown, said holddown having a circular spring having an aperture and upper and lower edges, said upper edge surrounding said aperture, a circular body encasing said spring, said body having an upper surface and a lower surface, said body having a hole concentric with said aperture, said hole and aperture being of a size sufficent to permit the interpositioning of the shaft of a headed fastener therein with said head bearing upon said upper surface adjacent to said upper edge of said spring, said shaft secured to said support with said sheet between said holddown and said support, said spring being deformable from an unbiased position to a biased position by a compressive force applied at said upper edge in a direction from said upper edge toward said lower edge by said fastener, said body being deformable from an unconstrained shape to a constrained shape with said deformation of said spring from said unbiased position to said biased position whereby said holddown and sheet are maintained in a watertight condition, said spring having central and outer portions, said central portion adjoining said upper edge, said central portion having an annular shape concentric with said aperture, said spring outer portion being between said central portion and said lower edge, said outer portion also having an annular shape concentric with said aperture, said central portion being above said outer portion when said spring is in said unbiased position.

15. The system of claim 14 wherein said roof support includes an under layer between said roof and said material.

16. The system of claim 14 wherein said body is compressed between said spring and said roof support.

17. The system of claim 14 wherein said spring is sufficiently deformable to maintain said spring in its biased position and said body in its constrained shape and said body compressed upon conformance of said holddown to the shape of said roof support.

* * * * *